United States Patent [19]

Stoll

[11] Patent Number: 4,505,251

[45] Date of Patent: Mar. 19, 1985

[54] CUTTING SEGMENT WITH POROUS CENTER SECTION

[76] Inventor: Martin Stoll, P.O. Box 410 520, 75 Karlsruhe 41, Fed. Rep. of Germany

[21] Appl. No.: 464,905

[22] Filed: Feb. 8, 1983

[30] Foreign Application Priority Data

Feb. 8, 1982 [DE] Fed. Rep. of Germany ..... 3204276

[51] Int. Cl.[3] ..... B28D 1/04

[52] U.S. Cl. ..... 125/15; 51/206 R

[58] Field of Search ..... 125/15; 51/206 R

[56] References Cited

U.S. PATENT DOCUMENTS

| | | | |
|---|---|---|---|
| 402,682 | 5/1889 | Lucas | 51/206 R |
| 1,163,356 | 12/1915 | Meyers | 125/15 |
| 1,403,416 | 1/1922 | Katzenstein | 51/206 R |
| 3,023,551 | 6/1962 | Osenberg | 125/15 |
| 3,028,710 | 4/1962 | Pratt | 51/206 R |
| 3,955,327 | 5/1976 | Franco | 51/206 R |

*Primary Examiner*—Harold D. Whitehead

*Attorney, Agent, or Firm*—James B. Middleton

[57] ABSTRACT

A cutting segment for stone and the like, the segment having a porous center section. A conventional mixture of cement and diamonds is made, and a quantity of filler is added to the mixture. The filler will withstand the sintering process, but subsequently falls out so pores are provided. A segment is made with only the center porous, while the side sections are as dense as is conventional. The result is that the porous section can receive coolant and/or the resulting slurry for efficient cutting, and the center section wears faster to yield a concave cutting edge.

3 Claims, 17 Drawing Figures

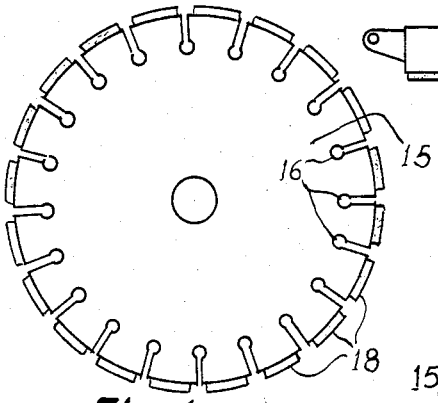
Fig. 1a
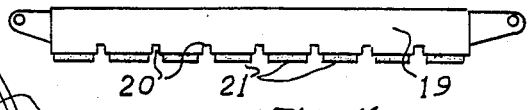
Fig. 1b
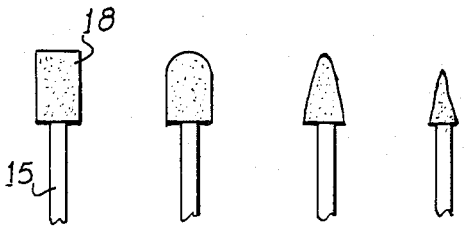
Fig. 2a PRIOR ART Fig. 2b PRIOR ART Fig. 3 PRIOR ART Fig. 4 PRIOR ART
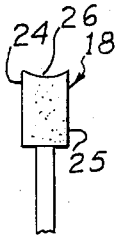
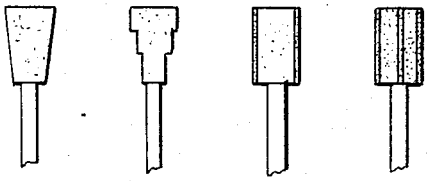
Fig. 5 PRIOR ART Fig. 6 PRIOR ART Fig. 7 PRIOR ART Fig. 8 PRIOR ART Fig. 9 PRIOR ART
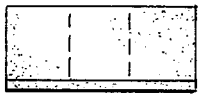
Fig. 10a PRIOR ART
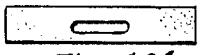
Fig. 10b PRIOR ART
PRIOR ART
Fig. 11a
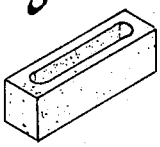
PRIOR ART
Fig. 11b
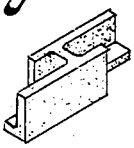
PRIOR ART
Fig. 11c
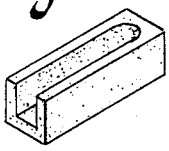
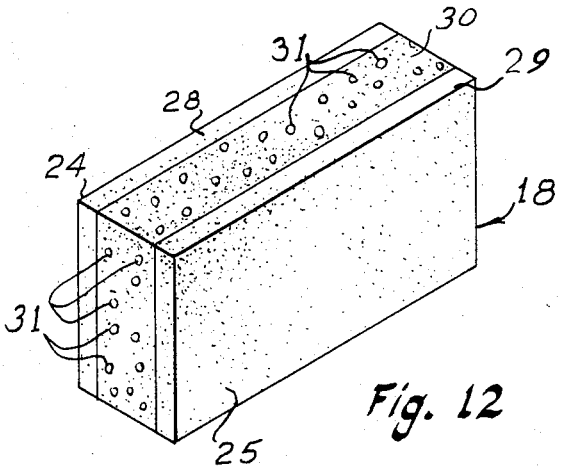
Fig. 12

CUTTING SEGMENT WITH POROUS CENTER SECTION

FIELD OF THE INVENTION

This invention relates generally to stone cutting tools, and is more particularly concerned with an improved diamond-impregnated segment for use on stone cutting tools.

BACKGROUND OF THE INVENTION

When hard materials such as natural stone, concrete and the like are to be cut or drilled, circular saws, gang saws or annular bits are used, the cutting edge of the tools being provided with diamond-impregnated segments or coatings. After use of the tool for cutting, the cutting edges of the tools become rounded due to the wear. This rounded cutting edge enlarges the surface that is in contact with the work piece, thereby increasing the power demands on the cutting machine and the blade that carries the cutting segments. Also, the rounded cutting edge leads to a lateral squeezing of the segment which puts great pressure on the segment. This increased pressure yields a poor quality cut, and causes portions of the segment to be broken off. Since the cutting segment needs to remain thick enough to provide a good kerf through the material, the breaking off of the sides of the segment renders the segment no longer usable.

Previous efforts at solving the above noted problems have included the use of various shapes of segments in an effort to cause the desired wear pattern on the segment, but these have been very expensive to produce, and many of the designs still tend to become rounded and are subject to the above stated difficulties. Another prior art effort at solving the problems has been to make the segment in layers, with the outer edges of the segment containing more diamond, or different sizes and qualities of diamond. Again, these segments are much more expensive to manufacture, and still do not wear precisely as desired.

SUMMARY OF THE INVENTION

The present invention overcomes the above mentioned and other difficulties with the prior art by providing a cutting segment having side sections and a center section, both the side sections and the center section being formed of a diamond-containing mixture, the center section including pores that do not contain the diamond-containing mixture. The pores may comprise a solid material that is other than the diamond-containing mixture, or may be voids; but, in either event, the porous section tends to wear more quickly to yield the desired configuration. The segment may be made in distinct layers to provide the side and center sections, or one mass of material may have the porosity introduced centrally thereof to achieve the same effect. It is contemplated that a relatively soft material will be mixed into the diamond-containing material, the relatively soft material being mixed generally uniformly to provide the pores.

BRIEF DESCRIPTION OF THE DRAWINGS

These and other features and advantages of the present invention will become apparent from consideration of the following specification when taken in conjunction with the accompanying drawings in which:

FIG. 1*a* is a side elevational view of a circular saw having cutting segments carried by the circumference;

FIG. 1*b* is a side elevational view of a gang saw having cutting segments carried by the cutting edge;

FIG. 2*a* is an end elevational view of a cutting segment as the segment is manufactured;

FIG. 2*b* is a view similar to FIG. 2*a* showing a prior art segment after some use;

FIGS. 3 and 4 are views similar to FIG. 2*b* showing prior art segments after extensive use;

FIG. 5 is an end elevational view of a cutting segment showing the preferred wear pattern for such segments;

FIGS. 6 and 7 are end elevational views showing two prior art configurations that are attempts to achieve the desired wear pattern;

FIGS. 8 and 9 are end elevational views showing two prior art segments using layers in an effort to achieve the desired wear pattern;

FIGS. 10*a*, 10*b* and 11*a*–11*c* are views of prior art segments having center portions designed to wear faster due to shape of the segments; and, FIG. 12 is a perspective view showing a cutting segment made in accordance with the present invention.

DESCRIPTION OF AN EMBODIMENT OF THE INVENTION

Referring now more particularly to the drawings and to that embodiment of the invention here presented by way of illustration, FIG. 1*a* shows a generally conventional circular saw 15 having notches 16 therearound as is conventional. The notches 16 are necessary for relief of the stone dust and the provision of water or other cooling liquid. Between the notches 16, each portion of the circumference of the saw 15 mounts a cutting segment 18.

FIG. 1*b* shows a gang saw, or reciprocating saw, 19, the saw 19 having spaced notches 29 with cutting segments 21 secured to the cutting edge between the notches 20.

FIG. 2*a* illustrates the usual configuration of a cutting segment as the segment is manufactured. It will be seen that the segment is designated as 18, and the cutting tool is designated 15. Those skilled in the art will understand that other cutting tools such as the gang saw 19, rotary cutting bits and the like will have similar segments similarly mounted, but the circular saw 15 is here used by way of example. The cutting segment 18 is generally rectangular and extends beyond each side of the saw 15 so a wide kerf will be provided. This will assure that only the cutting segments 18 actually engage the material being cut, and will thereby require a minimum of power to be provided to the saw 15.

FIG. 2*b* illustrates the usual wear pattern of the prior art cutting segments. The corners of the segment wear off so the cutting edge becomes rounded. Obviously, the rounded edge has a greater surface area, requiring more power to operate the cutting tool. Furthermore, as the segment is used further, the sides of the segment continue to wear so the segment becomes smaller and narrower as shown in FIGS. 3 and 4.

When the cutting segment is shaped as shown in FIG. 3, it will be seen that the cutting edge of the tool will tend to be wedged into the kerf, causing considerable lateral, or compressive, forces. These forces require an even greater amount of power on the cutting machine, and tend to break off the edges of the segment extending beyond the sides of the saw. It will therefore be seen that the width of the prior art cutting segment approaches the width of the saw itself.

FIG. 5 of the drawings illustrates the desired wear pattern of a cutting segment such as the segment 18. It will be seen that the sides 24 and 25 remain substantially straight, while the cutting edge 26 is somewhat concave. Because of this shape, it will be understood that the kerf remains of constant width, thereby allowing continuing freedom of movement of the saw 15 within the kerf without binding, or necessitating greater power. Also, because the leading edges of the cut are made by the side areas of the segment 18, the saw tends to move in a straight line through the material being cut. This is desirable both for the quality of the cut and to prevent torsional forces on the saw.

FIGS. 7 and 8 illustrate prior art shapes of segments. The object of these shapes is to prevent the wearing of the sides as shown in FIG. 3. While the sides may not be immediately worn away, the segment becomes progressively narrow, which leads to the same result. Also, the cutting edge of the segments still tends to become rounded as shown in FIG. 2*b*.

FIGS. 8 and 9 illustrate prior art segments utilizing layers to change the wear pattern. These segments have been made by mixing separate batches of diamonds and the cement mixture in which the diamonds are embedded. This procedure is expensive in itself, and sometimes higher quality diamonds are required in the side layers, thereby further increasing the cost.

FIGS. 10*a*, 10*b*, 11*a*, 11*b* and 11*c* all show prior art segments in which the center portion of the segment is designed to wear faster, simply because of the shape of the segment. In all cases it will be seen that a significant portion of the central area of the segment is omitted. These elaborate shapes are quite expensive to manufacture, and are provided with relatively thin wall members that may be broken easily since they do not have lateral support.

With the above in mind, and looking at FIG. 12 of the drawings, it will be seen that the segment, again designated as 18 by way of illustration, has side sections 28 and 29 and a center section 30. The three sections are here shown as delineated by discrete lines, but it will be understood that, in practice, the side sections and the center section may somewhat merge into one another without the clear line.

To achieve the center section 30, a relatively soft material is mixed into the diamond and cement mixture, so the center section 30 includes a plurality of pores 31 that do not include the diamond and cement mixture.

At this point it should be mentioned that the conventional segments are made by utilizing a cement material such as a cemented carbide or the like, mixing a quantity of diamond into the cement, and sintering the material to harden the cement. Those skilled in the art are well aware of this technique and will understand with no further discussion.

To provide a segment made in accordance with the present invention, the segment is made substantially the same as the prior art segments; however, to the cement and diamond mixture is added a quantity of a soft material. The soft material must nevertheless be able to withstand the sintering process and maintain the pores 31 in the completed segment. A material such as graphite is therefore desirable.

It should be realized that it is not necessary for the soft material to remain in place within the pores 31. The object is only to provide the generally uniform dispersion of pores throughout the center section 30. The soft material may subsequently fall out, or be driven out by the mechanical forces in the use of the segment. In any case, the uniform dispersion of the pores 31 in the center section 30 will cause the center section 30 to wear more quickly than the dense side sections 28 and 29. This will yield the ideal wear pattern shown in FIG. 5.

It will be seen that an important effect achieved by the porous center section 30 is that the pores of the center section can receive a quantity of cooling liquid so the cooling liquid will be applied directly to the cutting area. The resulting slurry can also be received by the porous center section 30 to allow the diamond direct contact with the material being cut, for more effective cutting.

The ratio of the filler of soft material to the cement and diamond mixture can be varied to change the wear pattern, more filler being added to allow faster wear. Also, using the present invention, one is not limited to any particular shape of segment, but the segments can be made in any shape desired. Further, while the side sections 28 and 29 may have different quantities and/or qualities of diamond if desired, the mixture for the entire segment may be the same, the faster wear being achieved solely through the use of the soft filler material to provide the porosity.

It will also be understood that the filler is soft relative to the cement, so numerous filler materials will suggest themselves to those skilled in the art.

It will therefore be understood that the particular embodiment of the invention here presented is by way of illustration only, and is meant to be in no way restrictive; therefore, numerous changes and modifications may be made, and the full use of equivalents resorted to, without departing from the spirit or scope of the invention as defined in the appended claims.

I claim:

1. In a stone cutting segment, wherein said segment is formed of a cement having diamonds dispersed therein, said segment having a cutting edge, side sections arranged perpendicularly to said cutting edge, and a center section disposed between said side sections so that said side sections and said center section form said cutting edge, both said side sections and said center section being formed of said cement having diamonds dispersed therein, the improvement wherein said center section includes a relatively soft material as compared to said cement dispersed therein, said relatively soft material being within a plurality of individual pores substantially uniformly distributed throughout said center section, said relatively soft material filling all said pores.

2. In a stone cutting segment as claimed in claim 1, the further improvement wherein pores substantially at said cutting edge will have said relatively soft material dislodged therefrom during cutting for defining pores for receiving liquid during such cutting.

3. In a stone cutting segment as claimed in claim 2, the improvement wherein said relatively soft material consists of graphite.

* * * * *